US005479968A

United States Patent [19]

Sanchez et al.

[11] Patent Number: 5,479,968

[45] Date of Patent: Jan. 2, 1996

[54] INK FILLING APPARATUS AND METHOD FOR FILLING INK CARTRIDGES

[75] Inventors: Ismael R. Sanchez; Alexander A. Antonelli, both of Rochester, N.Y.

[73] Assignee: Xerox Corporation, Stamford, Conn.

[21] Appl. No.: 106,727

[22] Filed: Aug. 16, 1993

[51] Int. Cl.[6] ..... B41J 2/175

[52] U.S. Cl. ..... 141/110; 141/2; 141/329; 141/80; 141/18; 346/140.1; 347/85

[58] Field of Search ..... 141/2, 4, 5, 7, 141/11, 12, 18, 21, 25, 31, 71, 73, 80, 110, 111, 285, 325–327, 329; 346/140.1; 347/7.85

[56] References Cited

U.S. PATENT DOCUMENTS

| | | | |
|---|---|---|---|
| Re. 10,827 | 4/1887 | Lockwood | 141/80 |
| 3,800,496 | 4/1974 | Bardet | 53/64 |
| 4,321,953 | 3/1982 | Grothoff | 141/2 |
| 4,464,668 | 8/1984 | Komai et al. | 346/75 |
| 4,633,923 | 1/1987 | Hinzmann | 141/116 |
| 4,699,054 | 10/1987 | Scrudato | 101/330 |
| 4,804,550 | 2/1989 | Bardsley et al. | 141/80 X |
| 4,968,998 | 11/1990 | Allen | 346/140 |

FOREIGN PATENT DOCUMENTS

| | | | |
|---|---|---|---|
| 0148360 | 7/1985 | European Pat. Off. | 141/73 |

*Primary Examiner*—J. Casimer Jacyna
*Attorney, Agent, or Firm*—Daniel J. Krieger

[57] ABSTRACT

An ink filling apparatus for filling ink cartridges with a quantity of ink. The ink filling apparatus includes ink injecting members or needles to inject ink into an ink saturating material or wicking medium contained in the ink cartridges. A compression member compresses the ink saturating medium while ink is injected into the saturating medium. A vent cover covers a vent tube in the ink cartridge and directs the flow of pressurized air or gas through the vent tube to prevent ink from entering the vent tube during the ink filling operation. A piston pump delivers a specific quantity of ink to the ink filling apparatus to accurately fill each ink cartridge.

21 Claims, 7 Drawing Sheets

INK FILLING APPARATUS AND METHOD FOR FILLING INK CARTRIDGES

FIELD OF THE INVENTION

This invention relates generally to ink cartridges for ink jet printers and more particularly to an apparatus and a method for filling ink cartridges with a quantity of ink.

BACKGROUND OF THE INVENTION

Cartridges filled with liquid ink are used in a number of applications from an ordinary ball point pen to the more recently developed ink cartridge for thermal ink jet printers. Ink cartridges are typically made from plastic or some other relatively inexpensive material. The ink cartridge includes a chamber sufficiently large for holding an adequate supply of ink to enable a user to write or print a significant amount of text before the cartridge must be disposed of or refilled due to lack of ink. Many cartridges used in thermal ink jet printers have chambers filled with a medium which absorbs and holds the ink and supplies sufficient backpressure to prevent unintended leakage or "weeping" of liquid ink out of the nozzles onto a surface being printed.

A typical end-user product for thermal ink jet printers is a cartridge in the form of a prepackaged, frequently disposable item comprising a sealed container holding a supply of liquid ink or toner and, operatively attached to a printhead having a linear or matrix array of channels connected to ink ejecting nozzles. Generally the cartridge may include terminals to interface with the electronic control of the printer; electronic parts in the cartridge itself are associated with the ink channels in the printhead, such as the resistors and any electronic temperature sensors, as well as digital means for converting incoming signals for imagewise operation of the heaters. In one common design of printer, the cartridge is held with the printhead against a sheet of paper on which an image is to be printed, and is then moved across the sheet periodically, in swaths, to form the image, much like a typewriter. Full-width linear arrays, in which the sheet is moved past a linear array of channels which extends across the full width of the sheet, are also known.

Typically, cartridges are purchased as needed by the consumer and used either until the supply of ink is exhausted, or, equally, if not more importantly, until the amount of ink in the cartridge becomes insufficient to maintain the back pressure of ink to the printhead within the useful range. Many different types of ink saturating or wicking mediums are used in the chambers of ink cartridges and include foam rubber, foam plastic, felt, reticulated polyurethane foam, and thermoset melamine condensate Of course, these cartridges need to be filled with a predetermined amount of ink, once, if the cartridge is disposable, or many times if the cartridge is refillable. In addition, because of the high demand for ink cartridges, an automatic filling apparatus is desirable to increase the manufacturing rate of the cartridges so that the customer requirements may be appropriately satisfied.

In U.S. Pat. No. 3,800,496 to Bardet, a machine for testing, filling, and sealing receptacles such as fountain pen cartridges is described. A cartridge is filled with a needle which receives an ink dose required for filling the cartridge, the ink dose is driven by a piston from a cylinder holding the dose.

U.S. Pat. No. 4,464,668 to Komai et al. describes an ink supply system for an ink jet recording apparatus which includes a supply pump for feeding ink to an accumulator for equalizing the pressure of the ink, and valve means for controlling the feeding of the ink under pressure to the recording head.

U.S. Pat. No. 4,633,923 to Hinzmann describes an apparatus for filling ink cartridges used in printer units of a cigarette machine, The apparatus includes a frame to support an empty cartridge for filling, a housing defining a chamber for holding ink, and a valving element for evacuating ink from the chamber to the ink cartridge.

U.S. Pat. No. 4,669,054 to Scrudato et al. describes a means for storing and introducing a metered supply of ink, to an ink cartridge during the operation of a printing device. Included is a bag container for holding ink, a conduit means for conducting ink to the ink cartridge, and a needle for penetrating an ink absorbing material contained in the cartridge.

U.S. Pat. No. 4,968,998 to Allen describes the resupply of liquid toner or ink to a print cartridge which is refillable at a service station in a printer. Liquid toner is forced under positive pressure to a refill tube on the print cartridge. Air and liquid toner are simultaneously evacuated from the cartridge through negative pressure through an evacuation tube on the print cartridge.

SUMMARY OF THE INVENTION

In accordance with one aspect of the invention, there is provided an apparatus for filling cartridges with a quantity of ink. The apparatus for filling ink cartridges includes an ink injecting member to supply ink to the ink cartridge, a support member to support the ink injecting member, a compression member to compress an ink saturating medium held by the ink cartridge and an actuating member to move the support member and to thereby move the ink injecting member into and out of the cartridge.

Pursuant to another aspect of the invention, there is provided a method for filling a chamber of an ink cartridge with a quantity of ink. The method for filling an ink cartridge includes the steps of compressing an ink saturating medium, inserting an ink injecting member into the ink saturating medium, delivering ink under pressure to the medium, decompressing the ink saturating medium, and terminating the deliver of ink to the ink saturating medium.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
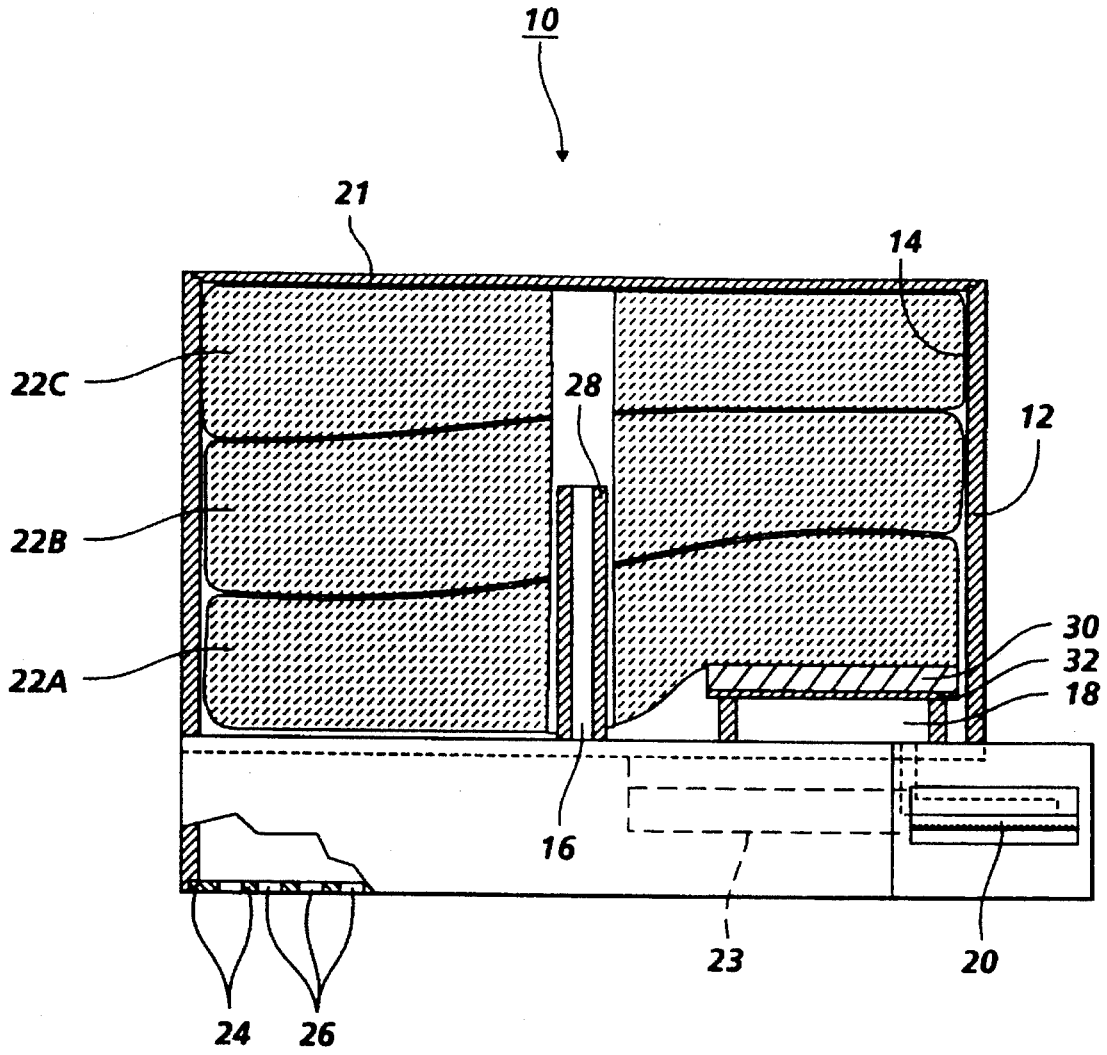
FIG. 1 is an elevational view, partially in section, of an ink cartridge.

FIG. 1 is an elevational view, partially in section, of an ink cartridge 10. The cartridge 10 has a main portion in the form of a housing 12. Housing 12 is typically made of a light-weight but durable plastic. Housing 12 defines a chamber 14 for the storage of liquid ink, and further has defined therein an air vent or ventilation port 16, open to the atmosphere, and an output port 18. At the end of the output port 18 (as shown at the broken portion of FIG. 1) is an ink jet printhead 20, and specifically the ink supply manifold thereof, substantially as described above. An ink-saturating medium, shown here as three separate portions marked 22A, B, and C occupies most of the chamber 14 of housing 12. A top cover plate 21 closes the chamber 14 once filled with ink.

Other parts of the cartridge 10 include a heat sink 23 and a cover 24 having openings 26 therein to permit ventilation of the interior of housing 12 through ventilation port 16. A practical design will typically include space for on-board circuitry for selective activation of the heating elements in the printhead 20. The cartridge 10 is described in U.S. patent application Ser. No. 07/885,704, "Ink Supply System For A Thermal Ink-Jet Printer" herein incorporated by reference.

Also shown in FIG. 1 is a vent member or tube 28 extending from ventilation port 16 toward the center of the interior of housing 12, through openings in each portion of medium 22. The purpose and function of tube 28 is described in detail in U.S. patent application Ser. No. 07/885,600, "Air Vent for an Ink Supply Cartridge in a Thermal Ink-Jet Printer" herein incorporated by reference.

Medium 22 (shown as three portions of material) is in the form of a needled felt of polyester fibers. Needled felt is made of fibers physically interlocked by the action of, for example, a needle loom, although in addition the fibers may be matted together by soaking or steam heating. Medium 22 is packed inside the enclosure of housing 12 in such a manner that the felt exerts reasonable contact and compression against the inner walls. In one commercially-practical embodiment of the cartridge 10, the medium 22 is created by stacking three layers of needled felt, each one-half inch in thickness, and packing them inside the housing 12.

Also within housing 12 is a member made of a material providing a high capillary pressure, indicated as scavenger 30. Scavenger 30 is a relatively small member which serves as a porous capillary barrier between the medium 22 and the output port 18, which leads to the manifold of printhead 20. The scavenger 30 includes a filter cloth 32, which is attached to the scavenger 30 using a porous hot-melt laminating adhesive. In general, the preferred material for the filter cloth 32 is monofilament polyester screening fabric. This filter cloth provides a number of practical advantages. Typically, no specific structure (such as a wire mesh) for holding the scavenger 30 against the opening into outlet port 18 is necessary. Further, there need not be any adhesive between the filter cloth 32 and the outlet port 18. The high capillary force provided by filter cloth 32 creates a film of ink between the filter cloth 32 and the outlet port 18, by virtue of the planarity (no wrinkles or bumps) of the filter cloth 32 against the scavenger 30, the compression of the scavenger 30 against the outlet port 18, and the saturation of the scavenger 30. This film serves to block out air from the outlet port 18.

In one commercially-practical embodiment of the present invention, the medium 22 is initially loaded with 68 cubic centimeters of liquid ink, of which it is desired to obtain at least 53 cubic centimeters for printing purposes while the back pressure of the cartridge is within a usable range.

Figure 2:
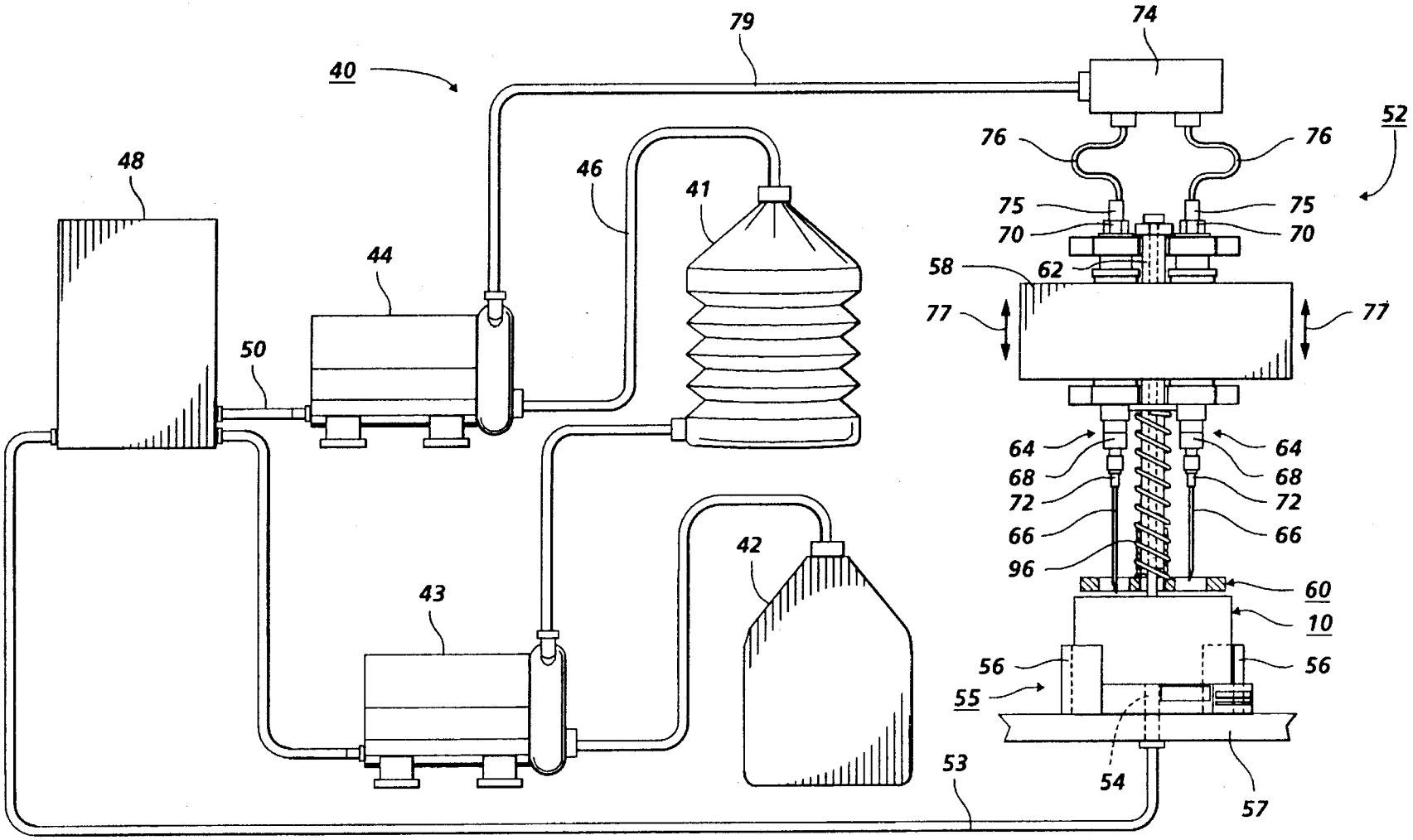
FIG. 2 is an elevational view of an ink filling apparatus of the present invention.

An ink filling apparatus 40 of the present invention for filling ink cartridge 10 is illustrated in FIG. 2. The ink filling apparatus 40 includes an air-free collapsible ink reservoir 41 containing a quantity of ink used to fill a plurality of ink cartridges 10. The reservoir 41 is filled from a second reservoir 42 and pump 43. The second reservoir 42 is a common container with a biological filter in a vent thereof. A pump 44 is coupled to the ink reservoir 42 through a line 46. The pump 44 uses air pressure supplied by an air compressor 48 coupled to the pump 44 through an air line 50 to extract ink from the reservoir 41. The pump 44 is a metering pump using a piston pump to extract a specific amount of ink from the reservoir 41 during a single pumping cycle to fill a single cartridge 10. In the present embodiment, the pump used is a model 4F3C-170 manufactured by HiBar Systems Ltd. of Canada.

An ink dispensing apparatus 52 dispenses ink into the cartridge 10 held by a fixture 55 having corner sections 56 coupled to a table 57. The corner sections 56 of the fixture 55 are arranged to engage each of the four corners of the cartridge 10 and to snugly fit against the outside of the housing 12 to thereby provide a stable mechanism for holding the cartridge in place during the ink filling operation. An air line 53 is connected to an air supply nozzle 54, connected to the ventilation port 16, to supply pressurized air to the ventilation port 16 to prevent ink from flowing into the tube 28 of the cartridge 10 during the ink filling operation. While the cartridge 10 is manually placed in the fixture 55 as described, it is within the scope of the invention to have a more automated assembly, utilizing for instance, a moving belt with a plurality of cartridges held thereto to provide for automatic filling of ink cartridges 10.

The ink dispensing apparatus 52 is mounted on the table 57 or some other stable platform for dispensing ink.

Figure 3:
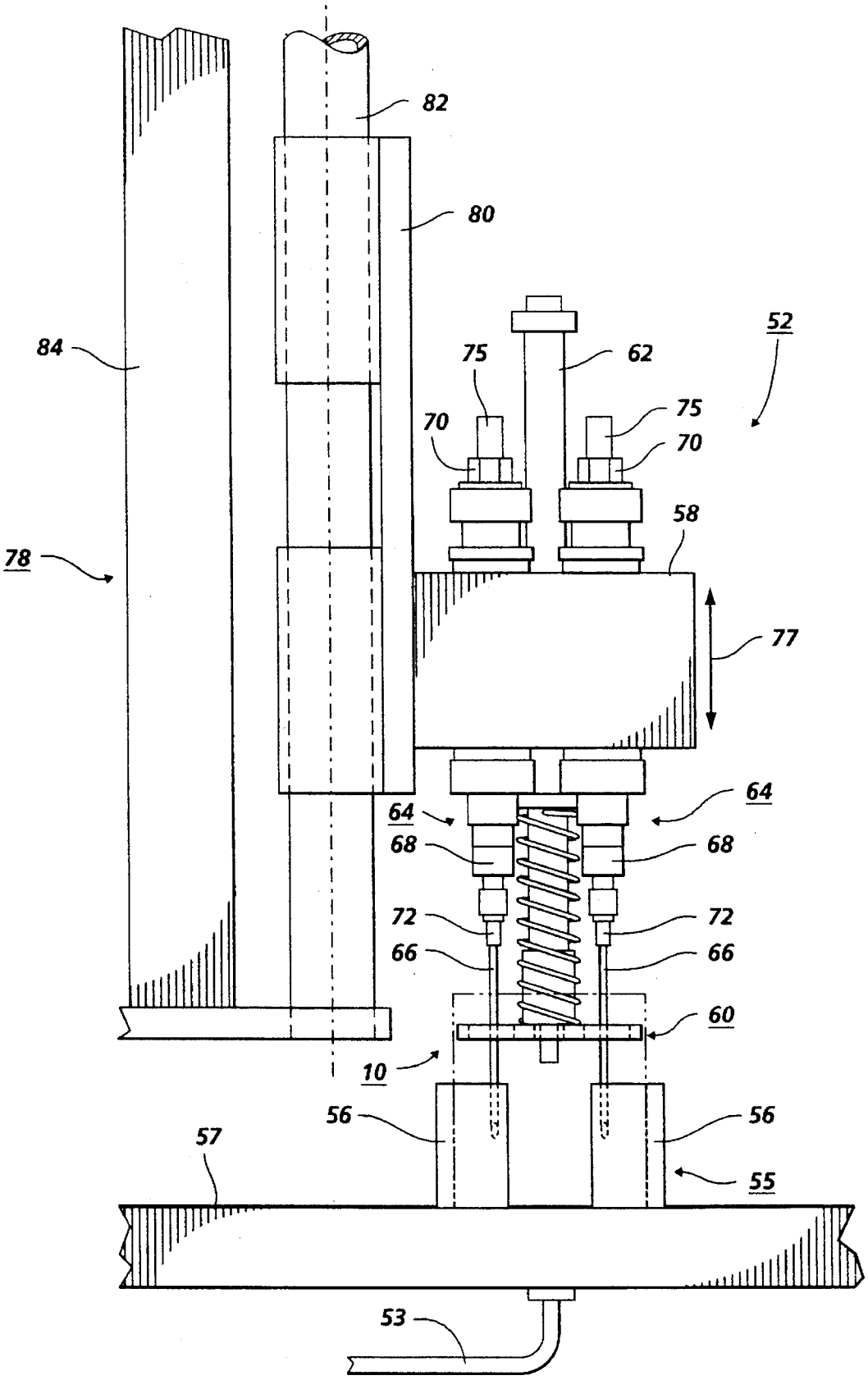
FIG. 3 is a side elevation view of an ink dispensing member, an actuating member, and a table for support of the ink cartridge for the filling operation.

The ink dispensing apparatus 52 includes a support member 58, a compression member 60, a vent body 62, and a plurality of ink injecting members 64 for penetrating the medium 22. The compression member 60, the vent body 62, and the ink injecting members 64 are coupled to the support member 58. Each of the ink injecting members 64 has a needle 66 coupled to an ink body 68. In the present embodiment four ink injecting members 64 are used to inject ink into the medium 22. Two ink injecting members 64 are located behind those illustrated for the total of four as can be seen in FIG. 3, illustrating a side view of the ink dispensing apparatus 52. The present invention is not limited to four ink injecting members, however, and more or less ink injecting members are possible. More than four ink injecting members have been tried successfully to decrease fill time and increase thruput.

The needles used in the present invention are VITA brand industrial needles, 16 gauge stainless steel. The needles are chosen for durability and the capability of easily penetrating the medium 22.

Each of the ink bodies 68 is supported by the support member 58. The ink bodies 68 have an input 70 and an output 72. Each of the inputs 70 is connected to a manifold 74 through a check valve 75 and a flexible tube 76. The manifold 74 is coupled to the ink line 79 to direct ink from the ink pump 44 to each of the ink injecting members 64. The manifold 74 includes four chambers which direct ink to each of the ink bodies 68 through the flexible tubes 76. The manifold 74 can either be attached to the support member 58 so that the manifold 74 moves when the support member 58 moves or the manifold 74 can be fixed with respect to the support member 58 so that the flexible tubes 76 flex during movement of the support member 58.

Figure 4:
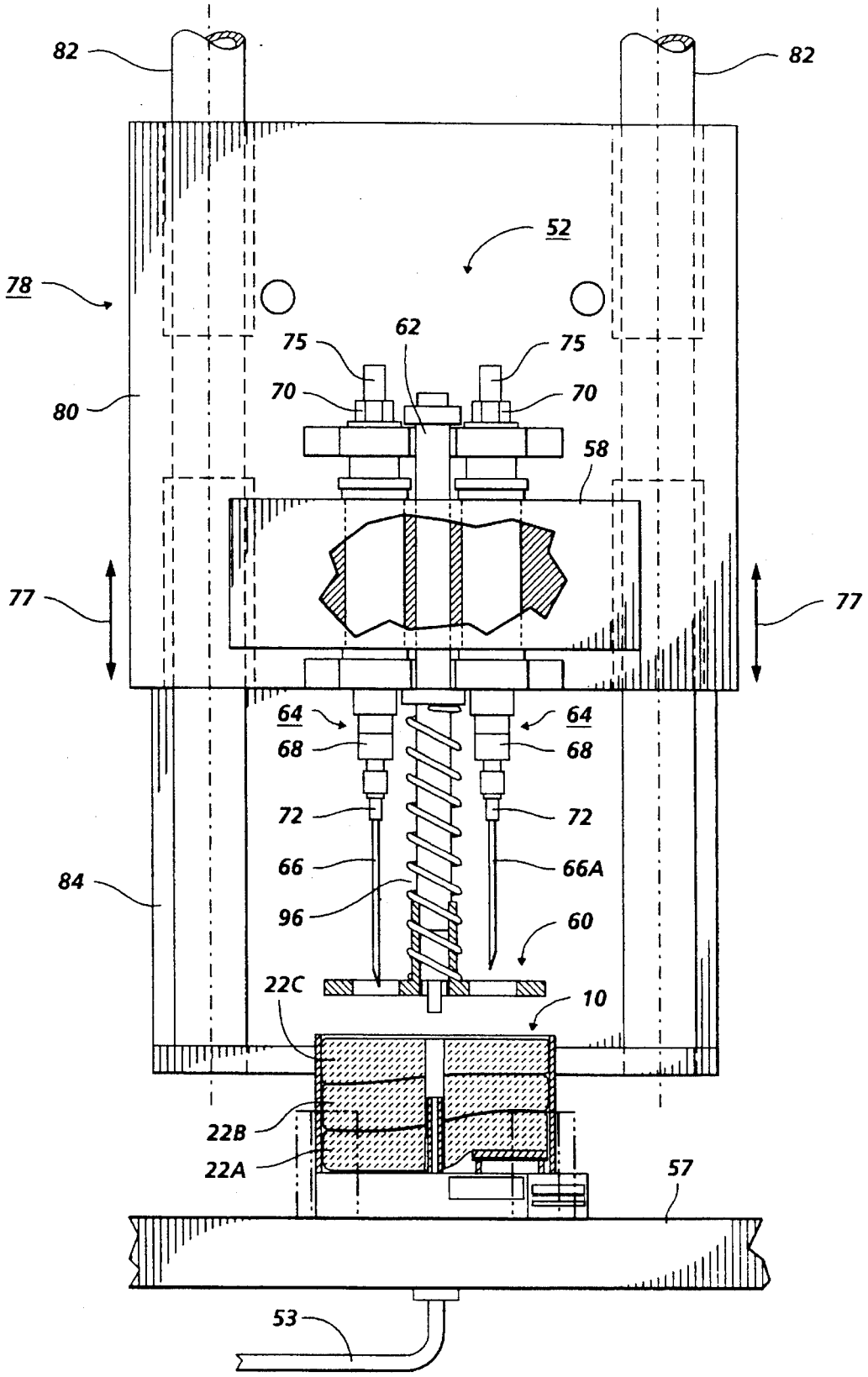
FIG. 4 is an elevational view, partially in section, of a front view of the ink dispensing apparatus, an ink cartridge, and a supporting table.

The support member 58 moves vertically in both directions, as indicated by the arrows 77. An actuating member 78 (see FIGS. 3 and 4) is operatively coupled to the support member 58 for moving the needles 66 into and out of the cartridge 10 for filling. The actuating member 78 includes a mounting plate 80 which is attached to the support member 58. The mounting plate 80 travels up and down along a vertical structure 82 which is attached to a stationary support 84 for supporting the support member 58.

The mounting plate 80 is moved in the vertical direction by an actuator or drive mechanism which causes the mounting plate 80 to be displaced along the vertical structure 82. The present invention uses wheels coupled to the mounting plate 80 which contact a stationary surface (not shown). The wheels are rotated against the stationary surface by motor control to cause vertical displacement of the support member 58 with respect to the vertical structure 82 as would be understood by one skilled in the art. The type of drive mechanism is not critical to the invention, however, so long as long as the vertical displacement of the mounting plate 80 with respect to the cartridge 10 is accurately controllable.

Figure 7:
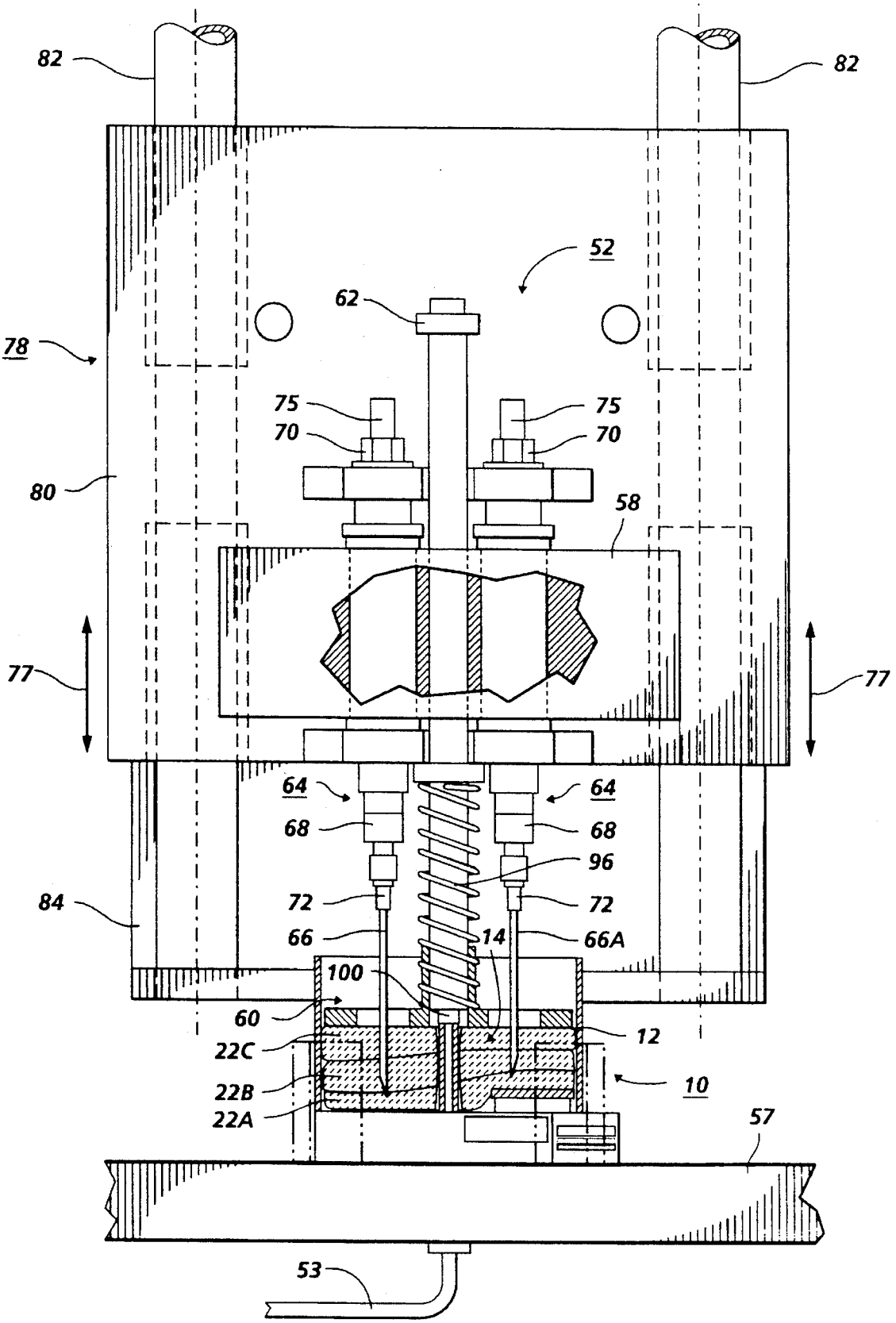
FIG. 7 is an elevational view, partially in section, of the ink dispensing member in a first position for filling the ink cartridge, an ink cartridge, and a supporting table.

Ink is injected into the medium 22 by the four needles 66. The needles 66 are driven into the medium by the downward movement of the mounting plate 80. The mounting plate 80 is controlled to position the support member 58 until the needles 66 are close to the bottom of the cartridge 10 and embedded into the bottom medium 22A as illustrated in FIG. 7. One needle, needle 66A, is slightly shorter than the other three needles to prevent the needle 66A from puncturing the scavenger 30. Needle length is, however, determined by the configuration of the cartridge being filled. As the needles are driven into the medium 22, the compression member 60 contacts the top medium 22C and the vent tube 28 is covered by the vent body 62.

Figure 5:
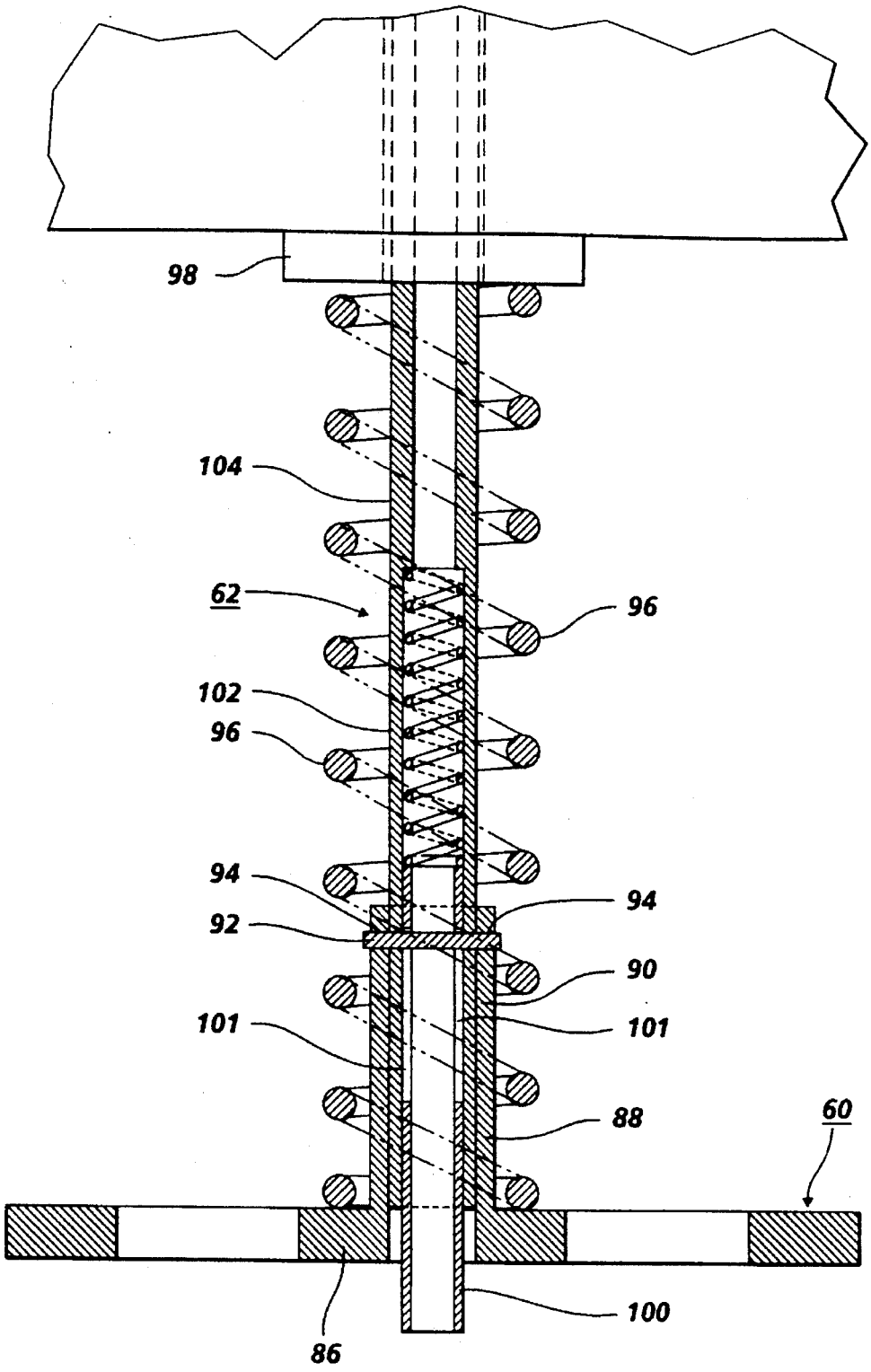
FIG. 5 is a sectional view of a compression member and a vent body.

FIG. 5 illustrates the assembly of the compression plate 60 and the vent body 62. The compression member 60 is spring loaded to compress the mediums 22 for filling thereof. Likewise, the vent body 62 includes a spring loaded mechanism to cover the vent tube 28 during filling of the cartridge 10. The compression member 60 comprises a flat plate 86 and a sleeve member 88. The sleeve member 88 can be a separate piece or the flat plate 86 and the sleeve member 88 can be a single piece. The sleeve member 88 fits outside the vent body 62. A pin 92 is inserted into opposing holes 94 in the vent body 62 and the sleeve member 88 to retain the sleeve member 88 to the vent body 62. A compression spring 96 is placed around the outside to the vent body 62 between the top portion of the flat plate 86 and the support member 58. The spring 96 provides a resistance against forces to the underside of the flat plate 86 which enables the plate 86 to compress the medium 22.

A vent cover 100 is located inside the vent body 62. The vent cover 100 protrudes past the bottom surface of the flat plate 86 and includes an elastic or deformable tip. The vent cover 100 includes slots 101 on opposite sides of the cover to allow for the retention of the cover 100 inside the vent body 62 and to allow the cover to move up and down. The pin 92 engages slots 101. A vent spring 102 is located above the vent cover 100 and contacts the top of the vent cover 100 and interior flanges 104. The vent spring 102 provides spring loading of the vent cover 100 to provide a tight seal of the vent cover 100 and the elastic tip to the vent tube 28 when the support member 58 moves the vent member 62 into contact with the tube 28.

Figure 6:
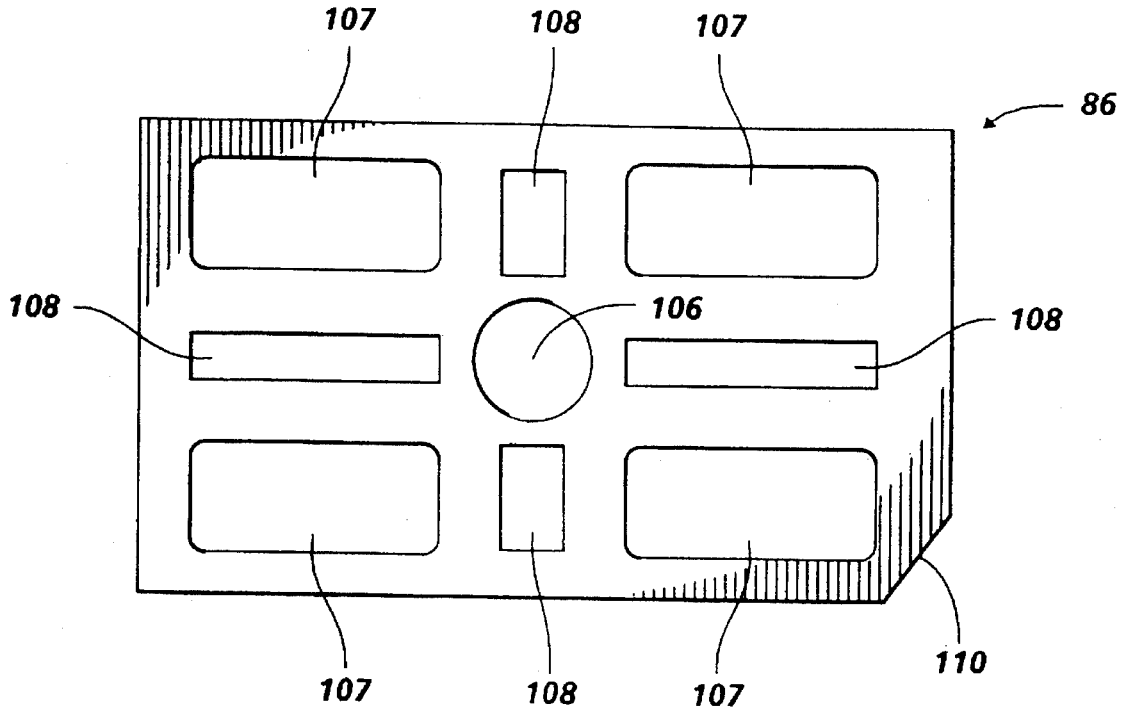
FIG. 6 is a plan view of a flat plate.

FIG. 6 illustrates a plan view of the flat plate 86. The sleeve member 88 is not illustrated. The flat plate 86 includes a center opening 106 to allow the vent body 62 to engage the vent tube 28 during filling of the cartridge 10. In addition to the center opening 106, the flat plate 86 includes a plurality of needle openings 107 which allow for the needles 66 to penetrate the medium 22. The needle openings 107 are substantially larger than the needles 66 to allow for the ink to rise above the flat plate 86 filling of the medium 22. In addition, fill openings 108, also allow for the ink to rise above the flat plate 86. The shape and size of the needle openings 107 and the fill openings 108 are not critical so long as ink can rise above the plate 86 during filling. A flat corner 110 merely allows the flat plate 86 to fit inside the cartridge 10 for filling.

FIG. 7 illustrates the compression of the medium 22 and a first location of the needles 66 during filling of the cartridge 10. The first step in the ink filling process includes compressing the medium 22, inserting the needles 66 into the medium 22, and covering the tube 28 with the vent cover 100. The needles 66 are inserted into the medium 22 by the downward movement of the mounting plate 80 under control of the actuator. Likewise, medium 22A, B and C are compressed by the compression member 60. The vent cover 100 covers the tube 28. The mounting plate 80 is moved downward to the point where the tips of the needles 66 are close to the bottom of the chamber 14 and embedded into the medium 22A. Before filling of the chamber 14 begins, air is delivered by the air compressor 48 over the line 53 to the ventilation port 16. As the vent cover 100 and the vent body 62 are hollow, the air flows up through the tube 28 and is vented to atmosphere out the top of the vent body 62. The fit of the vent cover 100 and the flow of air prevent ink from entering the tube 28 during the filling operation. The deformable tip aids in sealing the connection between the vent cover 100 and the tube 28.

Once the medium is compressed and the needles are in position, the pump 44 begins dispensing ink to the needles 66 through the manifold 74. Approximately 67.5 grams of ink are injected into the cartridge 10 to fill the chamber. Because there is essentially no back pressure on the needles 66, ink flows easily into the medium. Each needle receives approximately the same amount to ink, due to the of the characteristics of the medium. While the needles 66 are located near the bottom of the chamber 14, approximately one half of the ink is dispensed. Once one half of the ink is dispensed, the needles are moved approximately two-thirds of the way up from the bottom of the chamber. Because of the spring pressure on the compression member 62, the medium 22 are still compressed, although not as much as before so that the medium 22 begins to fill with ink due to absorption and to decompression of the medium. The remaining half of the ink is dispensed at this position. The quantity of ink dispensed is sufficient to flow over the top of the flat plate 86 through the needle openings 107 and the fill openings 108. Vent cover 100 remains in the same position preventing ink from entering vent hole. Once the filling cycle is completed by the pump, the needles move to a position just over the top of the medium 22 for approximately two seconds to allow for any dripping ink from the needles 66 and/or the compression member 60 to fall on the medium 22.

The pump 44 dispenses ink for approximately eight seconds. Two seconds are allowed for the ink to settle. Once the settling time is complete, the actuator moves the mounting plate 80 upward so that the compression member 62 and needles 66 are fully retracted from the medium 22. Once fully retracted, the pump 44 extracts the required amount of ink from the ink reservoir 42 to ready itself to fill another cartridge 10.

In recapitulation, there has been described an apparatus and method for filling ink cartridges and in particular thermal ink jet cartridges having an ink jet printhead. It is, therefore, apparent that there has been provided in accordance with the present invention, an apparatus and method for filling an ink cartridge that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An ink filling apparatus for filling ink cartridges with a quantity of ink, the cartridge having a housing defining a chamber for the storage of ink and an ink saturation medium in the chamber for holding the ink, said ink filling apparatus comprising:

an ink injecting member to penetrate the ink saturation medium;

a compression member to compress the ink saturation medium, said compression member defining an opening having a size larger than said ink ejecting member to permit said ink ejecting member to pass through said compression member; and an actuating member to move said ink injecting member through the opening and to penetrate the ink saturation medium to supply ink thereto.

2. An ink filling apparatus for filling ink cartridges with a quantity of ink, the cartridge having a housing defining a chamber for the storage of ink, the cartridge having a vent member for venting the chamber and an ink saturation medium in the chamber for holding the ink, said ink filling apparatus comprising;

an ink injecting member;

a compression member to compress the ink saturation medium, said compression member defining a first opening to accommodate said ink injecting member, said ink injecting member comprising a needle member to penetrate the ink saturation medium, said needle member being of a sufficient size to fit within the first opening defined by said compression member; and an actuating member to move said ink injecting member into communication with the ink saturation medium to supply ink thereto.

3. The ink filling apparatus of claim 2, wherein the first opening defined by said compression member is of a size significantly larger than said needle member to provide for ink flow through said compression member.

4. The ink filling apparatus of claim 3, wherein said compression member defines a second opening to allow ink to flow through the compression member.

5. The ink filling apparatus of claim 4, wherein said compression member comprises a spring actuated compression member.

6. The ink filling apparatus of claim 5, further comprising a pump member to pump ink to said ink injecting member.

7. The ink filling apparatus of claim 6, wherein said pump member comprises a piston pump to pump a specific quantity of ink during a pump cycle.

8. The ink filling apparatus of claim 7, further comprising an air pressure member coupled to the vent member for supplying a flow of air to the air vent.

9. The ink filling apparatus of claim 2, wherein said ink injecting member comprises a plurality of needle members to penetrate the ink saturation medium.

10. The ink filling apparatus of claim 9, further comprising a manifold coupled to each of said plurality of needle members to direct ink thereto.

11. The ink filling apparatus of claim 2, further comprising a vent body to engage the vent member.

12. The ink filling apparatus of claim 11, wherein said vent body includes a vent cover of a sufficient size to cover the vent member.

13. The ink filling apparatus of claim 12, wherein said vent body defines a hollow body to allow gas flow through the vent member and said vent body.

14. The ink filling apparatus of claim 13, wherein said vent cover comprises a spring actuated vent cover.

15. The ink filling apparatus of claim 14, wherein said compression member defines a third opening of a sufficient size to accommodate said vent body.

16. A method for filling a chamber of an ink cartridge with a quantity of ink, comprising the steps of:

compressing an ink saturating medium;

inserting an ink injecting member into the ink saturating medium;

delivering ink under pressure to the ink saturating medium;

decompressing the ink saturating medium; and terminating the delivery of ink to the ink saturating medium once the ink saturating medium contains a predetermined amount of ink.

17. The method of claim 16, further comprising the step of decompressing the ink saturating medium during said delivery step.

18. The method of claim 17, further comprising the step of covering a vent member of the ink cartridge before and during the delivery of ink to the ink saturating medium.

19. The method of claim 18, wherein said covering step includes covering the vent member with a vent body.

20. A method for filling a chamber of an ink cartridge with a quantity of ink, comprising the steps of:

compressing an ink saturating medium;

inserting an ink injecting member into the ink saturating medium;

delivering ink under pressure to the ink saturating medium;

covering a vent member of the ink cartridge before and during the delivery of ink to the ink saturating medium, said covering step including covering the vent member with a vent body;

forcing a gas through the vent member and the vent body during said delivery step;

decompressing the ink saturating medium during said delivery step; and terminating the delivery of ink to the ink saturating medium once the ink saturating medium contains a predetermined amount of ink.

21. The method of claim 20, further comprising the step of removing the ink injecting member from the ink saturating medium.

* * * * *